United States Patent [19]

Fortier et al.

[11] Patent Number: 5,019,215

[45] Date of Patent: May 28, 1991

[54] HEADBOX WITH CONDUITS HAVING MULTIPLY CONNECTED DOMAINS

[75] Inventors: Luc Y. Fortier, Pierrefonds; Andre G. Piette, Dollard-Des-Ormeaux, both of Canada

[73] Assignee: Groupe Laperrier & Verreault, Inc., Canada

[21] Appl. No.: 258,485

[22] Filed: Oct. 17, 1988

[51] Int. Cl.[5] ..... D21F 1/02

[52] U.S. Cl. ..... 162/343; 162/216

[58] Field of Search ..... 162/336, 343, 344, 216

[56] References Cited

U.S. PATENT DOCUMENTS

| | | | |
|---|---|---|---|
| 3,272,233 | 9/1966 | Trufitt | 162/343 |
| 3,514,372 | 5/1970 | Boyce et al. | 162/216 |
| 3,725,197 | 4/1973 | Dahl et al. | 162/343 |
| 3,769,153 | 10/1973 | Hill | 162/216 |
| 4,087,321 | 2/1978 | Schultz et al. | 162/343 |
| 4,104,116 | 8/1978 | Koskimies | 162/343 |
| 4,146,427 | 3/1979 | Hogel et al. | 162/343 |
| 4,566,945 | 1/1986 | Ewald et al. | 162/343 |
| 4,765,868 | 8/1988 | Fukiwara | 162/344 |

FOREIGN PATENT DOCUMENTS

| | | | |
|---|---|---|---|
| 2302196 | 8/1973 | Fed. Rep. of Germany | 162/343 |
| 93895 | 7/1980 | Japan | 162/343 |
| 457763 | 2/1975 | U.S.S.R. | 162/343 |

*Primary Examiner*—Karen M. Hastings

*Attorney, Agent, or Firm*—Jones, Day, Reavis & Pogue

[57] ABSTRACT

A headbox comprising an inlet chamber communicating with a source of fiber suspension, an outlet chamber with a discharge opening for the fiber suspension and a diffuser to establish a fluid path between the inlet and the outlet chambers. The diffuser includes a cluster of tubes, each being divided in two successive portions of larger cross-sectional area separated by a step-like transition. Each tube comprises a stem mounted in the initial portion thereof to define a ring shaped fiber suspension passage.

13 Claims, 3 Drawing Sheets

HEADBOX WITH CONDUITS HAVING MULTIPLY CONNECTED DOMAINS

FIELD OF THE INVENTION

The present invention relates to the general field of paper-making equipment and more particularly, to a novel headbox with a diffuser to improve the dispersion of fibers throughout the suspension.

BACKGROUND OF THE INVENTION

In the manufacture of paper, it has been recognized that the quality of the final product largely depends on the uniformity of the jet of fiber suspension delivered from the headbox to the paper-making machine. Prior attempts to establish a uniform distribution of fibers have involved using a diffuser installed between the inlet and the outlet chambers of the headbox and comprising a cluster of conduits with stepped widenings to promote a turbulent flow. This concept makes the subject of the U.S. Pat. H. Dahl et al., No. 3,725,197 which has been granted on Apr. 3, 1973.

Although this concept constitutes a substantial improvement over the prior art, throughout testing and experimentation, it has been found that this headbox design s not capable of providing optimum results in terms of uniformity of fiber distribution.

Therefore, an object of this invention is an improved headbox with superior fiber distribution characteristics and yet which is simple and inexpensive to manufacture.

The headbox, according to a preferred embodiment of this invention, comprises a diffuser mounted between the inlet and the outlet chambers of the headbox. The diffuser includes a cluster of conduits, each being divided into at least two successive portions of larger cross-sectional area, namely a first portion and a second portion, the second portion being located downstream respectively to the first portion.

In the first portion of the conduit is mounted an elongated stem that defines with an inner wall of the conduit a passage for conveying fiber suspension, the passage, in cross-section, having the shape of a multiply connected domain, such as an annulus.

Preferably, the transition between the first and second portions is abrupt to create vortices in the flow of the fiber suspension.

The above described conduit structure is advantageous for two reasons. Firstly, the multiply connected domain passage allows to obtain an increased contact surface between the fiber suspension and the conduit comparatively to a cylindrical passage, thus increasing the shear forces in the fiber suspension. Secondly, the abrupt transition permits to establish and maintain a controlled level of turbulence. Both factors contribute to break and disperse flocs present in the fiber suspension.

In a preferred embodiment, a stem is provided only in the first portion of the conduit, however, it may be envisaged to construct the stem as a stepped structure of diminishing cross-sectional area in the direction of the fiber suspension flow to define in the conduit a plurality of multiply connected domain passages of increasing dimension.

It has been found advantageous, although not essential, to provide the stem of each conduit of the diffuser with a channel including an inlet portion in fluid communication with the inlet chamber of the headbox, the channel further comprising two or more branches leading from the inlet portion to the fiber suspension passage in the conduit. This arrangement further promotes a turbulent flow because the flow of fiber suspension is split in two or more, and forced to effect a series of sharp bends before entering the fiber suspension passage in the conduit.

In summary, the present invention comprehends a headbox comprising:

an inlet chamber communicating with a source of fiber suspension, the fiber suspension having a direction of flow through the headbox;

an outlet chamber downstream of the inlet chamber, the outlet chamber comprising a discharge opening;

a diffuser mounted between the inlet chamber and the outlet chamber to establish a fluid path from the inlet chamber to the outlet chamber, the diffuser including a plurality of conduits, in fluid communication with the inlet and outlet chambers, each conduit being divided in at least two successive portions, referenced as a first portion and a second portion establishing first and second fiber suspension passages respectively, the first passage having a smaller cross-sectional area than the second passage, each of the conduits including an elongated stem mounted therein, the first passage being defined between the stem and an inner wall of the conduit, the first passage defining in cross-section a multiply connected domain; and the elongated stem constituting means to create an abrupt enlargement of the cross-sectional area of the conduit at a juncture between the passages in the direction of flow through the headbox, for producing a vortex in the flow of fiber suspension through the conduit.

The invention also extends to a headbox comprising:

an inlet chamber communicating with a source of fiber suspension, the fiber suspension having a direction of flow through the headbox;

an outlet chamber downstream of the inlet chamber, the outlet chamber comprising a discharge opening;

a diffuser mounted between the inlet and outlet chambers to establish a fluid path therebetween, the diffuser including a plurality of conduits in fluid communication with the chambers, each conduit including at least two successive portions establishing respective fiber suspension passages of larger cross-sectional area in the direction of fiber suspension flow through the conduit, a stem mounted in each of the conduits, one of the passages being defined between the stem and an inner wall of the conduit, the one of the passages defining in cross-section a multiply connected domain; and the elongated stem constituting means to create an abrupt enlargement of the cross-sectional area of the conduit at a juncture between the passages in the direction of flow through the headbox, for producing a vortex in the flow of fiber suspension through the conduit.

The invention further comprehends a headbox, comprising:

an inlet chamber communicating with a source of fiber suspension, the fiber suspension having a direction of flow through the headbox;

an outlet chamber downstream of the inlet chamber, the outlet chamber comprising a discharge opening;

a diffuser mounted between the inlet and outlet chambers to establish a fluid path therebetween, the diffuser including a plurality of conduits in fluid communication with the inlet and outlet chambers, each conduit having a predetermined internal volume and including an elongated member received in an initial portion of the conduit, the elongated member filling partially the internal volume to establish in the conduit an initial passage and at least one additional passage downstream of the initial passage, the initial passage having a smaller cross-sectional area than the additional passage, the elongated member constituting means to create an abrupt enlargement of the cross-sectional area of the conduit at a juncture between the passages in the direction of flow through the headbox, for producing a vortex in the flow of fiber suspension through the conduit, the initial passage being defined between the elongated member and an inner wall of the conduit, the initial passage defining in cross-section a multiply connected domain.

Yet, the invention extends to a headbox, comprising:

an inlet chamber communicating with a source of fiber suspension, the fiber suspension having a direction of flow through the headbox;

an outlet chamber downstream of the inlet chamber comprising a discharge opening;

a diffuser mounted between the inlet and outlet chambers to establish a fluid path therebetween, the diffuser having a plurality of conduits in fluid communication with the inlet and outlet chambers, each conduit having a predetermined internal volume and comprising:

i) an elongated member mounted in the conduit for filling partially the internal volume to define in the conduit two successive passages of different cross-sectional areas, referenced as a first passage and a second passage, the first passage being defined between the elongated member and an inner wall of the conduit and having a smaller cross-sectional area than the second passage;

ii) between the passages a zone of abrupt transition from one cross-sectional area value to another, the zone of abrupt transition constituting means to create a vortex in the flow of fiber suspension through the conduit;

iii) channel means in the elongated member to establish a fluid communication between the passages and the inlet chamber.

The invention further extends to a headbox comprising:

an inlet chamber communicating with a source of fiber suspension, the fiber suspension having a direction of flow through the headbox;

an outlet chamber downstream of the inlet chamber, the outlet chamber comprising a discharge opening;

a diffuser mounted between the inlet chamber and the outlet chamber to establish a fluid path from the inlet chamber to the outlet chamber, the diffuser including a plurality of conduits in fluid communication with the inlet and outlet chambers, each conduit being divided in at least two successive portions, referenced as a first portion and a second portion establishing first and second fiber suspension passages respectively, the first passage having a smaller cross-sectional area than the second passage, each of the conduits including an elongated stem mounted therein, the first passage being defined between the stem and an inner wall of the conduit, the first passage defining a cross-section a multiply connected domain, a section of the conduit coextensive with the stem having a generally constant cross-sectional area throughout its length in absence of the stem; and an abrupt transition between the passages, the abrupt transition constituting means to create a vortex in the flow of fiber suspension through the conduit.

BRIEF DESCRIPTION OF THE DRAWINGS

FIG. 9*a* shows a doubly connected domain and FIG. 9*b* an ntuply connected domain.

Throughout the drawings, similar elements are designated by the same reference numerals.

DESCRIPTION OF A PREFERRED EMBODIMENT

Figure 1:
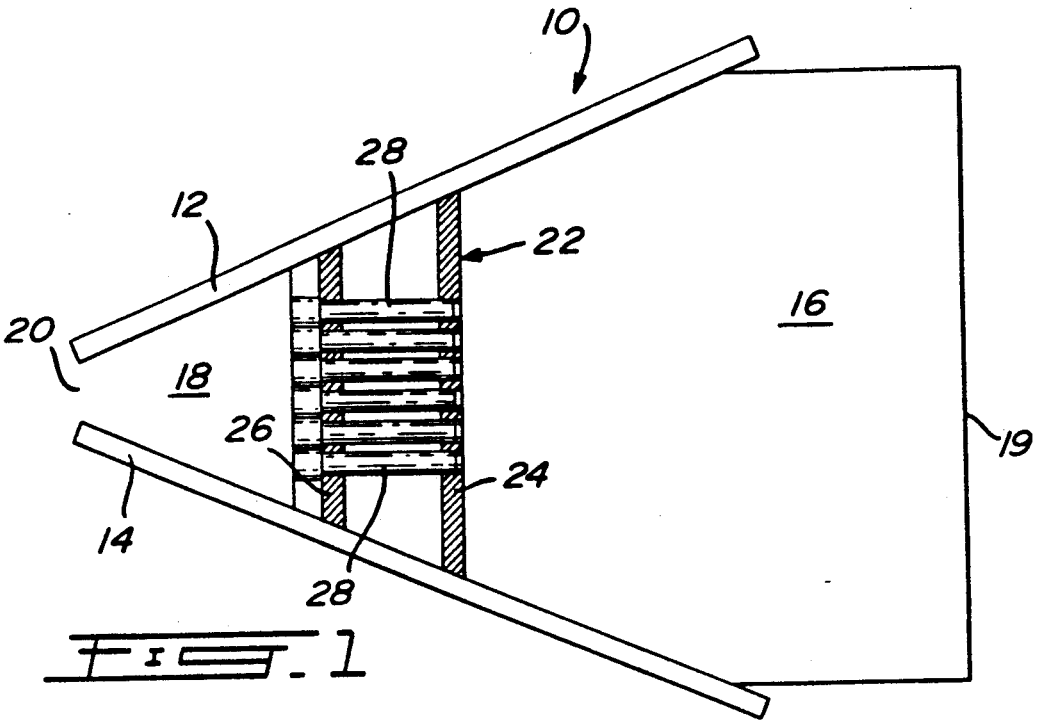
FIG. 1 is a schematical vertical cross-sectional view of a headbox constructed in accordance with this invention.

Referring now to FIG. 1, the reference numeral 10 designates in general a headbox shown in cross-section that is used to continuously supply fiber suspension to a foraminous carrier of a paper machine. The headbox 10 comprises a pair of converging top and bottom walls 12 and 14 respectively, constructed from metallic plates. At one end, the plates 12 and 14 define an inlet chamber 16 closed by a wall 19. The inlet chamber 16 is connected to a suitable supply of fiber suspension.

Opposite the inlet chamber 16, the plates 12 and 14 define an outlet chamber 18 which is generally triangular in cross-section. The outlet chamber 18 is provided with a slice opening 20 for discharging fiber suspension, extending the entire width of the headbox 10 and being defined between the extremities of the plates 12 and 14.

Between the inlet and the outlet chambers 16 and 18 respectively, is mounted a diffuser 22 to establish a fluid path between these chambers. The diffuser 22 comprises a pair of parallel metallic plates 24 and 26 extending the entire width of the headbox 10 and being secured to the plates 12 and 14 by welding or by any other appropriate means. The plates 24 and 26 constitute a support for a cluster of tubes 28 which may or may not be parallel, defining fiber suspension passages between the inlet and the outlet chambers 16 and 18 respectively.

Figure 2:
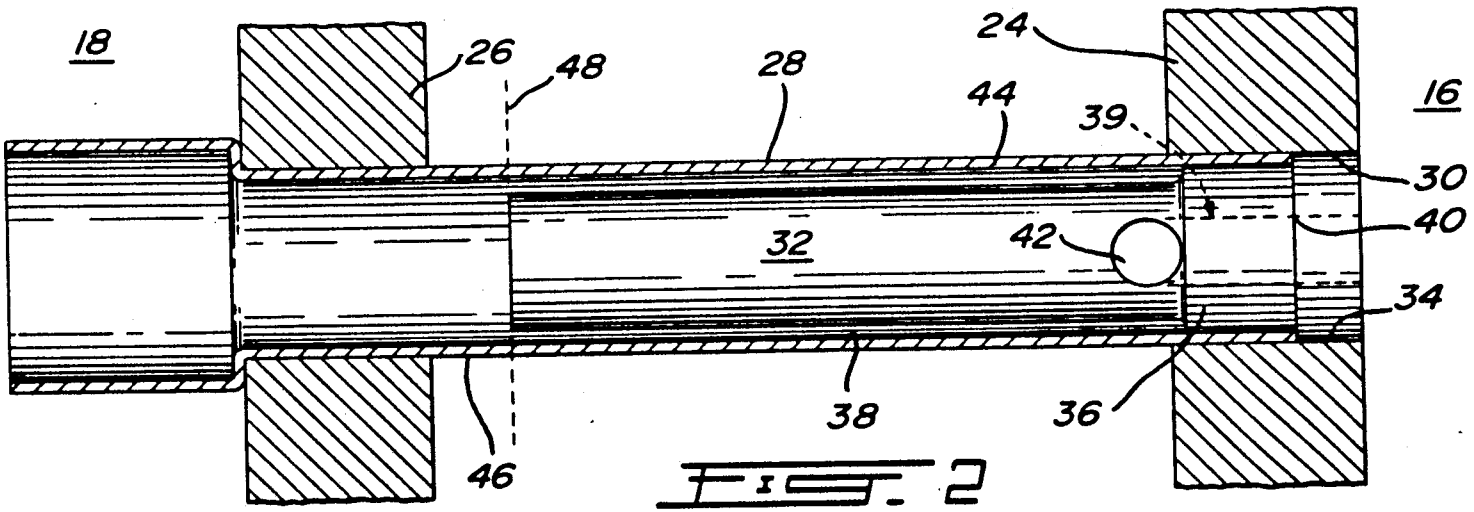
FIG. 2 is an enlarged cross-sectional view of the headbox diffuser showing a single fiber suspension conduit.

As best shown in FIG. 2, each tube 28 is of a generally constant cross-section throughout the length thereof except at the extremity thereof extending in the outlet chamber 18 which is slightly enlarged. The tube 28 is made of metallic material and it is secured in respective bores provided in the plates 24 and 26 by welding or by any other appropriate means. The extremity of the tube 28 received in the plate 24 is slightly recessed to define a seat 30.

In the tube 28 is received a metallic stem 32 having at one end an annular ridge 34 secured in the seat 30. Downstream of the annular ridge 34, the radius of the stem 32 is reduced by an amount corresponding generally to the wall thickness of the tube 28 to provide a circular portion 36 received within the conduit 28 and sealingly engaging the inner wall thereof.

Downstream of the circular portion 36, the stem diameter is reduced once again to define between the outer surface of the stem 32 and the inner wall of the conduit 28, in cross-section, a passage 38 for conveying fiber suspension, shaped as an annulus or, more generally stated, defining a multiply connected domain.

Figure 8:
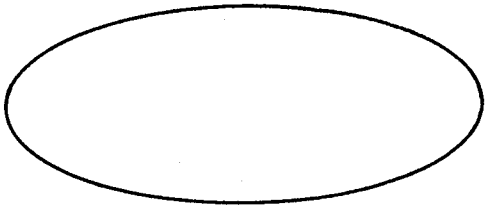
FIG. 8 illustrates a simply connected domain.

In plain terms, a domain is simply connected if it has no "holes". More precisely, a domain is simply connected if, for every simple closed curve in the domain, the region encompassed by the curve lies wholly in the domain. A simply connected domain is shown in FIG. 8.

Examples of simply connected domains are the following: the interior of a circle, the interior of a square, a sector, a quadrant, the whole xy plane. The annular region between two circles is not simply connected, nor is the interior of a circle minus the center point.

Figure 9B:
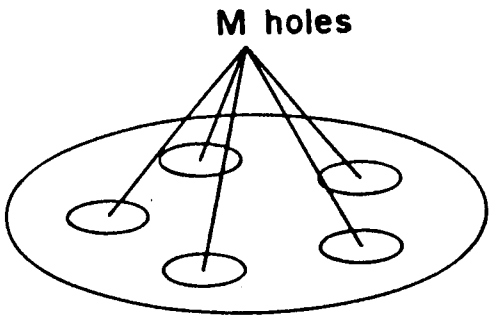
FIGS. 9*a* and 9*b* illustrate multiply connected domains, more particularly.
Figure 9A:
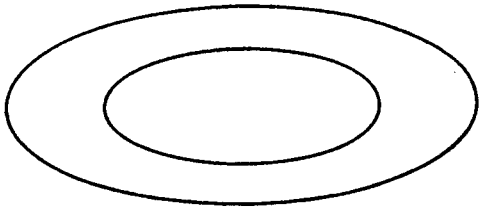

One can distinguish between types of multiply connected domains as follows: a domain with just one hole is doubly connected (see FIG. 9*a*), one with two holes is triply connected; one with $n-1$ holes is ntuply connected (see FIG. 9*b*).

Figure 4:
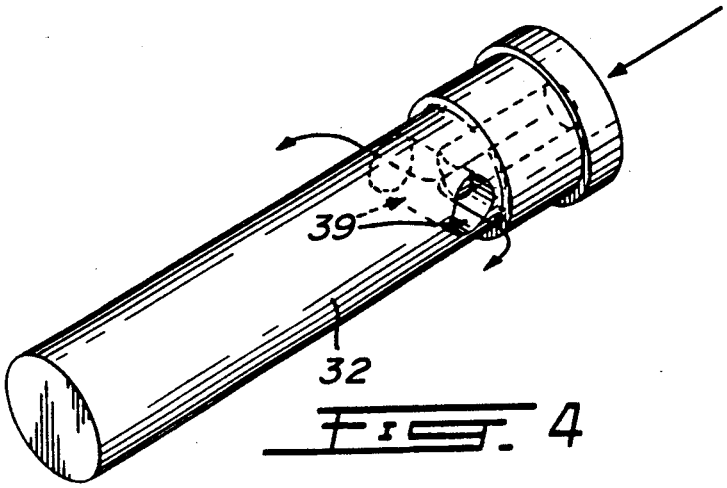
FIG. 4 is a perspective view of the stem shown in FIG. 2 schematically illustrating the fiber suspension flow.

The passage 38 communicates with the inlet chamber 16 through a channel structure 39 including an inlet portion constituted by a straight centrally located and longitudinally extending bore 40 opening in the inlet chamber 16 and extending slightly beyond the circular portion 36 to unite with a cross bore 42 communicating with the passage 38. The channel structure 39, which is somewhat T shaped as best shown in FIG. 4, has the effect of splitting in two the flow of fiber suspension and subjecting the flow to two 90° bends to augment the turbulence for better uniformity of the fiber distribution in the suspension.

Figure 5:
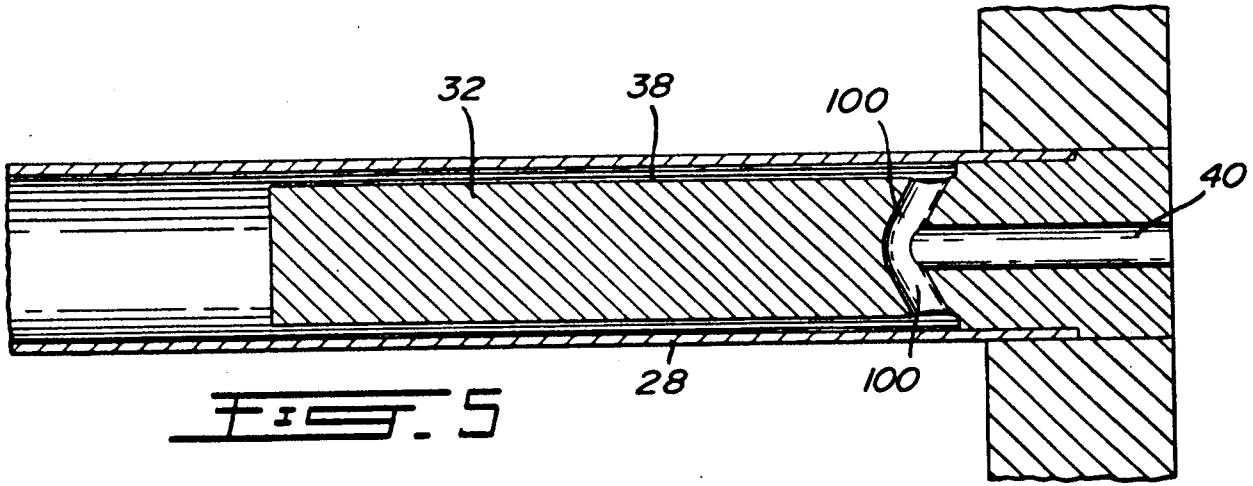
FIG. 5 is a variant of the stem shown in FIG. 2.

In a first variant, illustrated in FIG. 5, the centrally located bore 40 communicates with the passage 38 by two generally oppositely extending passages 100, each passage 100 defining an obtuse angle with the axis of the stem 32. Stated otherwise, the passages 100 force the flow of fiber suspension to effect a bend in excess of 90° when leaving the central conduit 40.

Figure 6:
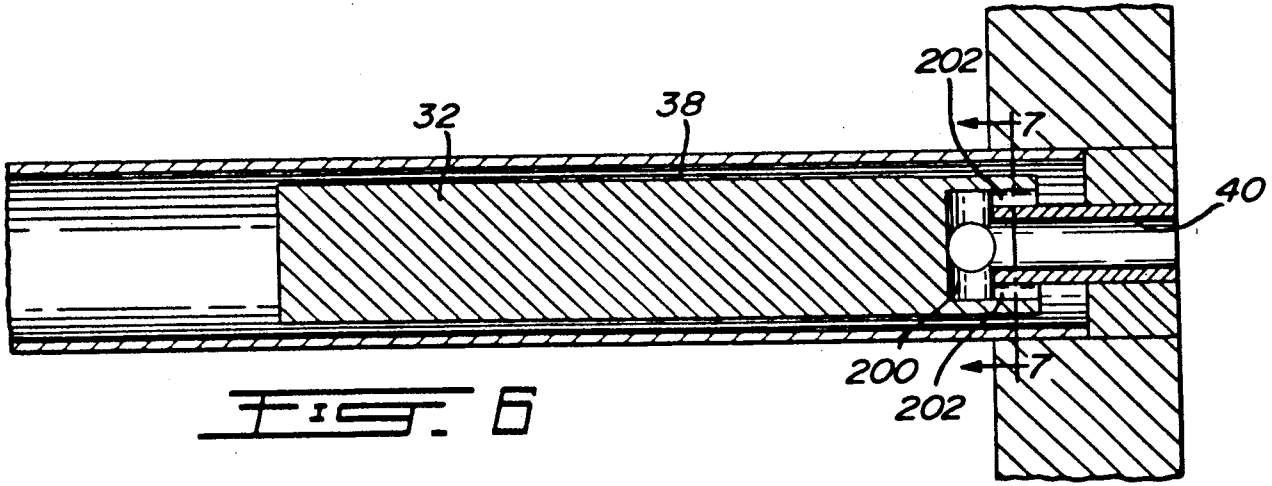
FIG. 6 is another variant of the stem shown in FIG. 2.
Figure 7:
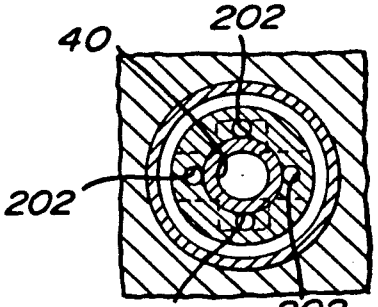
FIG. 7 is a view taken along lines 7—7 in FIG. 6.

In another variant, illustrated in FIGS. 6 and 7, the centrally located bore 40 leads to a chamber 200 communicating with the passage 38 through four passages 202 parallel with the central conduit 40. The central conduit 40, the chamber 200 and the passages 202 force the flow of fiber suspension to effect two 180 degrees bends before reaching the passage 38.

The embodiment illustrated in FIGS. 5, 6 and 7 are suitable for applications where it is desirable to substantially augment the turbulence in the flow of fiber suspension before it enters the annular passage 38.

Referring back to FIG. 2, the length of the stem 32 is somewhat shorter than the overall length of the tube 28 to divide the tube in two portions, namely a first portion 44 and a second portion 46 which are separated by an imaginary plane tangent to the free end of the stem 32 and being identified by the dotted line 48. The second portion 46 defines a cylindrical fiber suspension passage of larger cross-sectional area than the ring shaped passage 38 of the first portion 44, the first and second passages being separated by an abrupt transition produced by the sudden termination of the stem 32. The abrupt transition contributes to created vortexes in the fiber suspension flow to establish and maintain a controlled level of turbulence.

Figure 3:
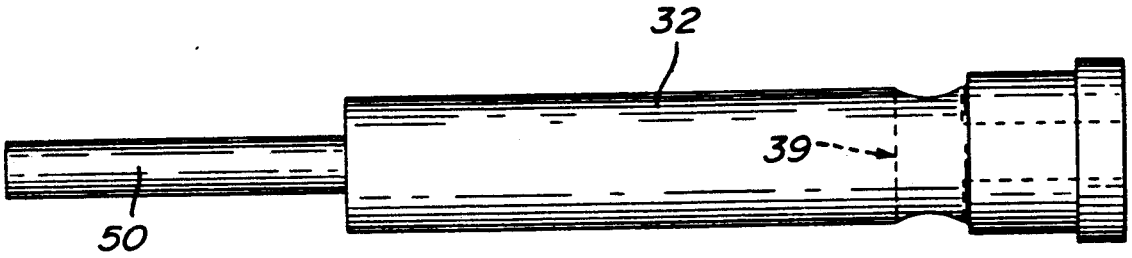
FIG. 3 is an elevational view of a variant of a stem adapted to be mounted within the fiber suspension conduit shown in FIG. 2.

In a variant of the invention shown in FIG. 3, the stem 32 has a stepped structure creating in the tube 28 three successive passages of larger cross-sectional area separated by abrupt transitions, namely two adjacent ring-shaped passages followed by a cylindrical passage.

It may be envisaged to construct the stem of three or more serially connected sections providing the desired number of ring-shaped passages in the tube 28.

The dimensions of the various elements of the tube 28 and of the stem 32 are selected according to the desired flow characteristics.

The above description of a preferred embodiment of this invention has been given only as an example and it should not be interpreted in any limiting manner because it may be refined and modified in various ways without departing from the spirit of the invention. The scope of the invention will be defined in the appended claims.

We claim:

1. A headbox comprising:

an inlet chamber communicating with a source of fiber suspension, said fiber suspension having a direction of flow through the headbox;

an outlet chamber downstream of said inlet chamber, said outlet chamber comprising a discharge opening;

a diffuser mounted between said inlet chamber and said outlet chamber to establish a fluid path from said inlet chamber to said outlet chamber, said diffuser including a plurality of conduits in fluid communication with said inlet and outlet chambers, each conduit being divided in at least two successive portions, referenced as a first portion and a second portion establishing first and second fiber suspension passages respectively, said first passage having a smaller cross-sectional area than said second passage, each of said conduits including an elongated stem mounted therein such that said second portion is free of said stem, said first passage being defined between said stem and an inner wall of said conduit, said first passage defining in cross-section a multiply connected domain; and said elongated stem constituting means to create an abrupt enlargement of the cross-sectional area of the conduit at a juncture between said passages in the direction of flow through the headbox, for producing a vortex in the flow of fiber suspension through the conduit.

2. A headbox as defined in claim 1, wherein said stem has a stepped structure of diminishing cross-sectional area in the direction of fiber suspension flow in said conduit.

3. A headbox as defined in claim 1, further comprising a channel structure in said stem to supply fiber suspension from said inlet chamber to said first passage, said channel structure comprising an inlet portion in fluid communication with said inlet chamber and a plurality of branches leading from said inlet portion to said first passage.

4. A headbox as defined in claim 3, wherein each branch forms a right angle with a longitudinal axis of said inlet portion.

5. A headbox as defined in claim 3, wherein said channel structure is T shaped.

6. A headbox as defined in claim 3, wherein each branch defines an obtuse angle with a longitudinal axis of said inlet portion.

7. A headbox as defined in claim 3, wherein said branches are generally parallel with said inlet portion.

8. A headbox comprising:

an inlet chamber communicating with a source of fiber suspension, said fiber suspension having a direction of flow through the headbox;

an outlet chamber downstream of said inlet chamber, said outlet chamber comprising a discharge opening;

a diffuser mounted between said inlet and outlet chambers to establish a fluid path therebetween, said diffuser including a plurality of conduits in fluid communication with said chambers, each conduit having a beginning and including at least first and second successive portions establishing respective fiber suspension passages of larger cross-sectional area in the direction of fiber suspension flow through said conduit, the first portion being located at the beginning of said conduit, a stem mounted in each of said conduits, one of said passages being defined between said stem and an inner wall of said conduit, said one of said passages defining in cross-section a multiply connected domain; each said conduit having a generally constant cross-sectional area in the absence of said stem; and said elongated stem constituting means to create an abrupt enlargement of the cross-sectional area of the conduit at a juncture between said passages in the direction of flow through the headbox; for producing a vortex in the flow of fiber suspension through the conduit.

9. A headbox comprising:

an inlet chamber communicating with a source of fiber suspension, said fiber suspension having a direction of flow through said headbox;

an outlet chamber downstream of said inlet chamber, said outlet chamber comprising a discharge opening;

a diffuser mounted between said inlet and outlet chambers to establish a fluid path therebetween, said diffuser including a plurality of conduits in fluid communication with said inlet and outlet chambers, each conduit having a predetermined internal volume and including an elongated member received in an initial portion of said conduit, said elongated member filling partially said internal volume to establish in said conduit an initial passage and at least one additional passage downstream of said initial passage, said initial passage having a smaller cross-sectional area than said additional passage, said elongated member including a channel means therein to establish a fluid communication between said inlet chamber and said initial passage, said elongated member constituting means to create an abrupt enlargement of the cross-sectional area of the conduit at a juncture between said passages in the direction of flow through the headbox, for producing a vortex in the flow of fiber suspension through said conduit, said initial passage being defined between said elongated member and an inner wall of said conduit, said initial passage defining in cross-section a multiply connected domain.

10. A headbox, as defined in claim 9, wherein said additional passage is free of said elongated member.

11. A headbox, as defined in claim 9, wherein said elongated member has a stepped structure of diminishing cross-sectional area in the direction of fiber suspension flow in said conduit.

12. A headbox, comprising:

an inlet chamber communicating with a source of fiber suspension, said fiber suspension having a direction of flow through said headbox;

an outlet chamber downstream of said inlet chamber comprising a discharge opening;

a diffuser mounted between said inlet and outlet chambers to establish a fluid path therebetween, said diffuser having a plurality of conduits in fluid communication with said inlet and outlet chambers, each conduit having a predetermined internal volume and comprising:

i) an elongated member mounted in said conduit for filling partially said internal volume to define in said conduit two successive passages of different cross-sectional areas, referenced as a first passage and a second passage, said first passage being defined between said elongated member and an inner wall of said conduit and having a smaller cross-sectional area than said second passage;

ii) between said passages a zone of abrupt transition from one cross-sectional area value to another, said zone of abrupt transition constituting means to create a vortex in the flow of fiber suspension through said conduit;

iii) channel means in said elongated member to establish a fluid communication between said passages and said inlet chamber.

13. A headbox comprising:

an inlet chamber communicating with a source of fiber suspension, said fiber suspension having a direction of flow through the headbox;

an outlet chamber downstream of said inlet chamber, said outlet chamber comprising a discharge opening;

a diffuser mounted between said inlet chamber and said outlet chamber to establish a fluid path from said inlet chamber to said outlet chamber, said diffuser including a plurality of conduits in fluid communication with said inlet and outlet chambers, each conduit having a beginning and being divided in at least two successive portions, referenced as a first portion and a second portion establishing first and second fiber suspension passages respectively, said first passage being located at the beginning of the conduit and having a smaller cross-sectional area than said second passage, each of said conduits including an elongated stem mounted therein, said first passage being defined between said stem and an inner wall of said conduit, said first passage defining in cross-section a multiply connected domain, said conduit coextensive with said stem having a generally constant cross-sectional area throughout its length in absence of said stem; and an abrupt transition between said passages, said abrupt transition constituting means to create a vortex in the flow of fiber suspension through said conduit.

* * * * *